United States Patent [19]

McEntire

[11] Patent Number: 4,937,923

[45] Date of Patent: Jul. 3, 1990

[54] POSITIVE-LOCK QUICK-RELEASE BUCKLE

[75] Inventor: B. Joseph McEntire, Warminster, Pa.

[73] Assignee: Gentex Corporation, Carbondale, Pa.

[21] Appl. No.: 231,068

[22] Filed: Aug. 11, 1988

[51] Int. Cl.[5] ..... A44B 11/25

[52] U.S. Cl. ..... 24/647; 24/650

[58] Field of Search ..... 24/68 CD, 647, 643, 24/650, 645, 638, 585, 179, 191, 641, 637

[56] References Cited

U.S. PATENT DOCUMENTS

| | | | |
|---|---|---|---|
| 2,710,999 | 6/1955 | Davis | 24/650 X |
| 2,846,745 | 8/1958 | Lathrop | 24/638 X |
| 2,869,200 | 1/1959 | Phillips et al. . | |
| 2,901,794 | 9/1959 | Prete . | |
| 2,904,866 | 9/1959 | Carter . | |
| 2,933,795 | 4/1960 | Meeker | 24/647 |
| 2,965,942 | 12/1960 | Carter . | |
| 3,020,612 | 2/1962 | Meeker . | |
| 3,142,103 | 7/1964 | Lindblad | 24/638 |
| 3,217,370 | 11/1965 | Sharpsteen et al. . | |
| 3,321,817 | 5/1967 | Smith et al. | 24/641 X |
| 3,608,158 | 3/1969 | Bengtsson . | |
| 3,678,542 | 7/1972 | Prete . | |
| 3,852,855 | 12/1974 | Bengtsson . | |
| 4,464,811 | 8/1984 | Holmes | 24/68 CD |
| 4,631,784 | 12/1986 | Fildan . | |
| 4,669,155 | 6/1987 | Chen . | |

FOREIGN PATENT DOCUMENTS

| | | | |
|---|---|---|---|
| 979448 | 1/1965 | United Kingdom | 24/647 |

*Primary Examiner*—James R. Brittain

*Attorney, Agent, or Firm*—Shenier & O'Connor

[57] ABSTRACT

A buckle assembly in which a base having upstanding sidewalls defines a passageway for receiving a tongue having a recess formed therein. A latch pivotally supported by the base sidewalls above the passageway has a catch portion adapted to extend downward into the tongue recess to prevent withdrawal of the tongue from a passageway and a clamping surface adapted to bear against the upper surface of the tongue upon attempted withdrawal of the tongue from the passageway. The latch is resiliently biased to a limit position defined by stops in which the catch portion extends into the passageway while the clamping portion remains substantially clear of the passageway and the latch handle remains recessed within the sidewalls.

9 Claims, 3 Drawing Sheets

Fig 5
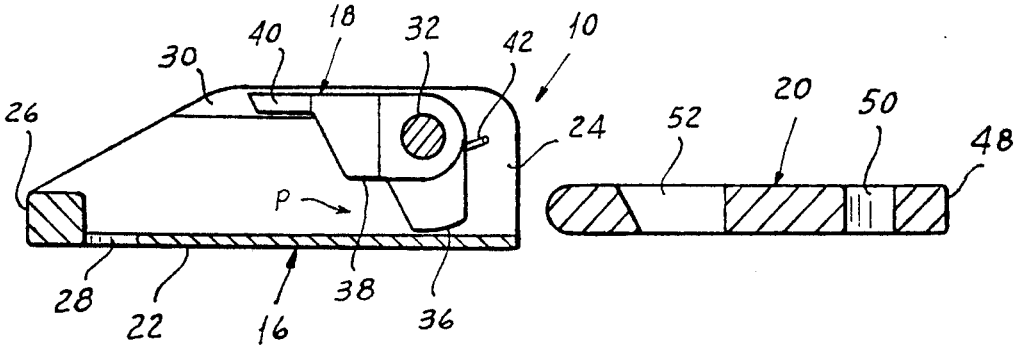
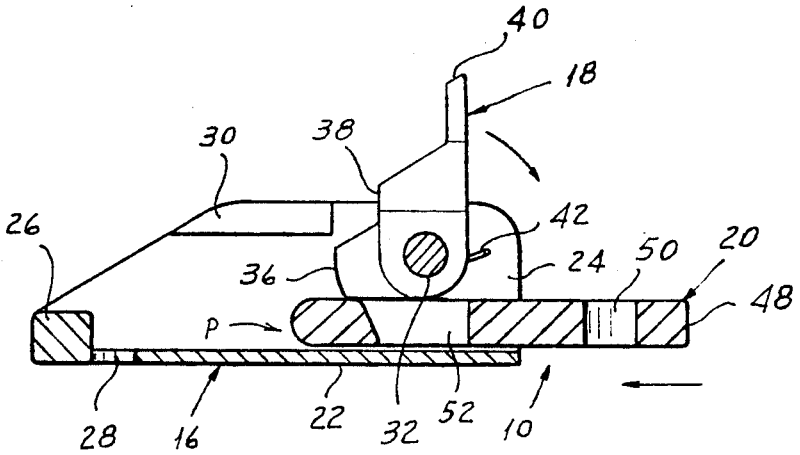
Fig 6
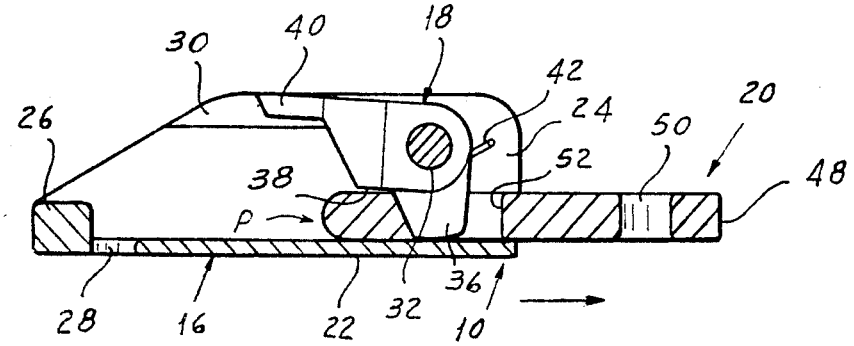
Fig 7

POSITIVE-LOCK QUICK-RELEASE BUCKLE

FIELD OF THE INVENTION

This invention relates to the field of protective and sports equipment and, more particularly, to the field of protective headgear using a chinstrap for retaining the headgear on the wearer.

BACKGROUND OF THE INVENTION

The use of fasteners for retaining protective equipment such as helmets or other headgear on a wearer is well known in the art. Fasteners currently in use include snap fasteners, D-rings and other configurations of metal and plastic fasteners. Effective protection in a threatening environment requires that such retaining means remain secured, sometimes under a load of 440 pounds or more. On the other hand, in some instances such as fire it may be necessary for the wearer to quickly remove the protective device. Prior-art fasteners that are satisfactory for most purposes generally do not fulfill those additional requirements of high load strength and ease of disconnection.

SUMMARY OF THE INVENTION

One object of my invention is to provide a fastener which remains fastened under loads at least as great as 440 pounds.

Another object of my invention is to provide a fastener which actually becomes more resistant to separation with an increase of applied load.

A further object of my invention is to provide a fastener with a quick release for emergency egress.

Yet another object of my invention is to provide a fastener that resists inadvertent release in normal and threatening environments.

Still another object of my invention is to provide a fastener that has a low profile and is lightweight and simple to operate.

Other and further objects of my invention will appear from the following description.

In one aspect, my invention contemplates a buckle assembly in which a base defines a passageway for receiving a tongue having a recess. A latch pivotally supported by the base adjacent to the passageway has a catch adapted to extend into the recess to retain the tongue in the passageway and a portion adapted to clamp the tongue against the base upon attempted withdrawal of the tongue from the passageway. The latch is resiliently biased to a limit position in which the catch extends into the passageway while the clamping portion remains substantially clear of the passageway.

In another aspect, my invention contemplates a buckle assembly in which a base having a pair or sidewalls defining a passageway for receiving a tongue pivotally supports a latch having a catch adapted to extend into a recess in the tongue and a handle adapted to extend downstream of the catch. The handle is biased toward the passageway to a limit position defined by means on one or preferably both of the sidewalls. In a preferred form of this aspect of my invention, the handle has portions extending into recesses formed in the sidewalls which define a limit position within the sidewalls.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 5 is a reduced section of the buckle assembly of FIG. 1 with the tongue disconnected.

FIG. 6 is a reduced section of the buckle assembly of FIG. 1 with the tongue nearly fully inserted.

FIG. 7 is a reduced section of the buckle assembly of FIG. 1 with the tongue locked in place.

DESCRIPTION OF THE PREFERRED EMBODIMENT

Figure 1:
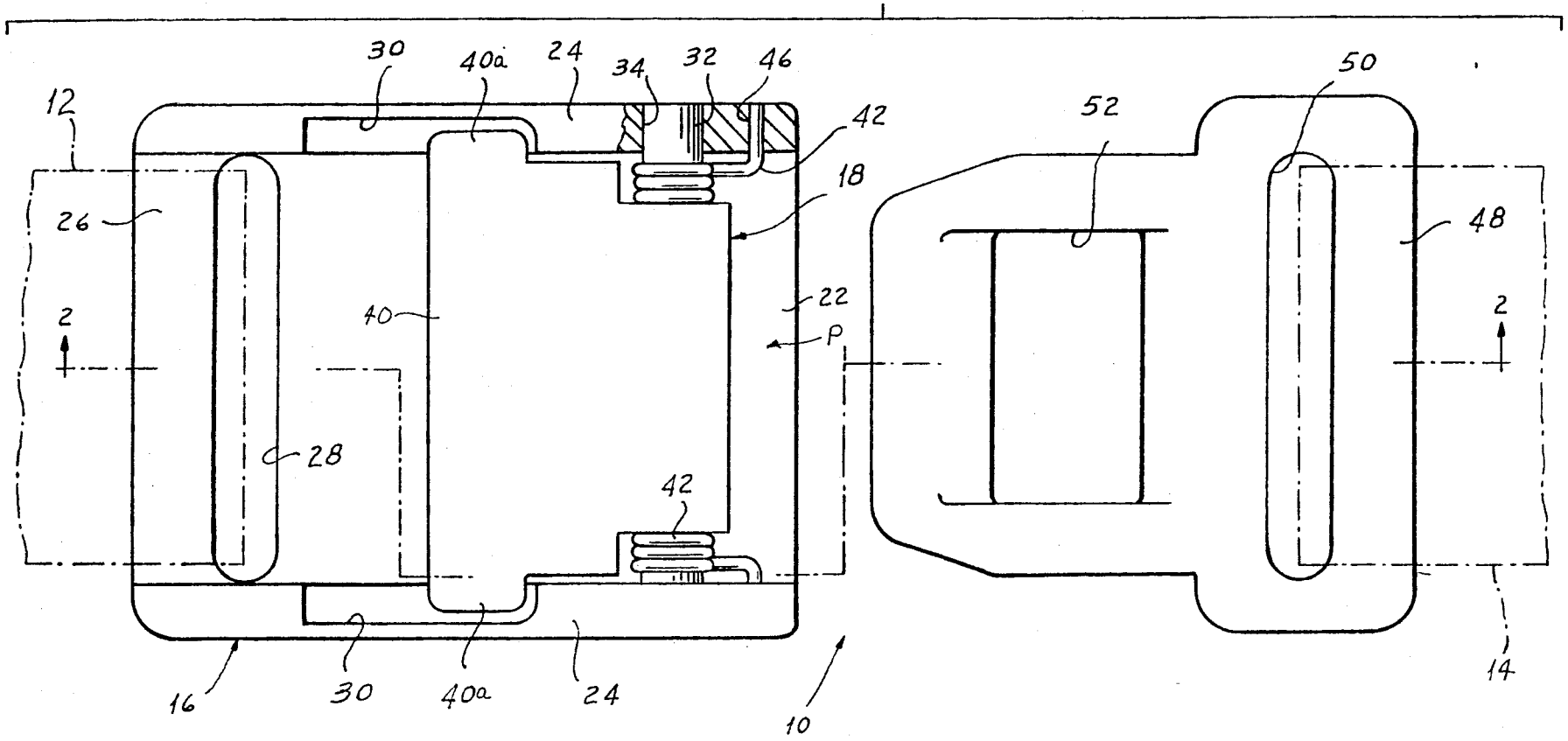
FIG. 1 is a top plan of a buckle assembly incorporating my invention, with parts shown in section.

Referring first to FIGS. 1 to 4, my buckle assembly, indicated generally by the reference numeral 10, is used to secure two strap ends 12 and 14 which are looped and which are formed of any suitable material, preferably a fabric, having the requisite amount of tensile strength. The buckle assembly 10 includes a base, indicated generally by the reference numeral 16, formed of a suitable material such as aluminum. Base 16 has mounted thereon a latch, indicated generally by the reference numeral 18, which engages a tongue indicated generally by the reference numeral 20, which is separable from the base-and-latch subassembly. Base 16 includes a bottom wall 22 and oppositely disposed sidewalls 24 defining a passageway P for receiving tongue 20. The left end of base 16, as viewed in FIGS. 1 and 2, includes a crossbar 26 which cooperates with bottom wall 22 to form a transverse slot 28 for receiving a loop of strap end 12.

Holes 34 formed in sidewalls 24 above the passageway P for tongue 20 receive a pin 32, which is held in place by a press fit between the pin and the base 16 and which pivotally supports latch 18. Latch 18 includes a catch portion 36 which extends downwardly into the passageway P in the position of the latch 18 shown in FIGS. 1 to 3. Latch 18 is also formed with a portion 38 to the left of downwardly extending portion 36, as viewed in FIG. 2, which, as described below, bears against the upper surface of tongue 20 to clamp the tongue as well as to prevent further counterclockwise rotation of latch 18. Finally, latch 18 includes a handle portion 40 which may be actuated by the user to pivot the latch 18 clockwise as viewed in FIG. 2 to release the assembly 10. Referring to FIG. 1, handle 40 includes portions **40*a* which extend laterally into recesses 30 formed in sidewalls 24. Respective torsion springs 42 carried by pin 32 between latch 18 and sidewalls 24 resiliently bias latch 18 counterclockwise, as viewed in FIG. 2, to a position in which extensions 40*a* of handle 40 bear against the upwardly facing surfaces of recesses 30 and clamping portion 38 remains substantially clear of the passageway. (To simplify the views, latch 18 is shown in FIGS. 1 to 3 and 5 in an intermediate position in which extensions 40*a* are spaced slightly from the surfaces of recesses 30.) Each of torsion springs 42 has a first end extending into a bore 44 formed in latch 18 and a second end extending into an aperture 46 formed in sidewall 24**.

Figure 2:
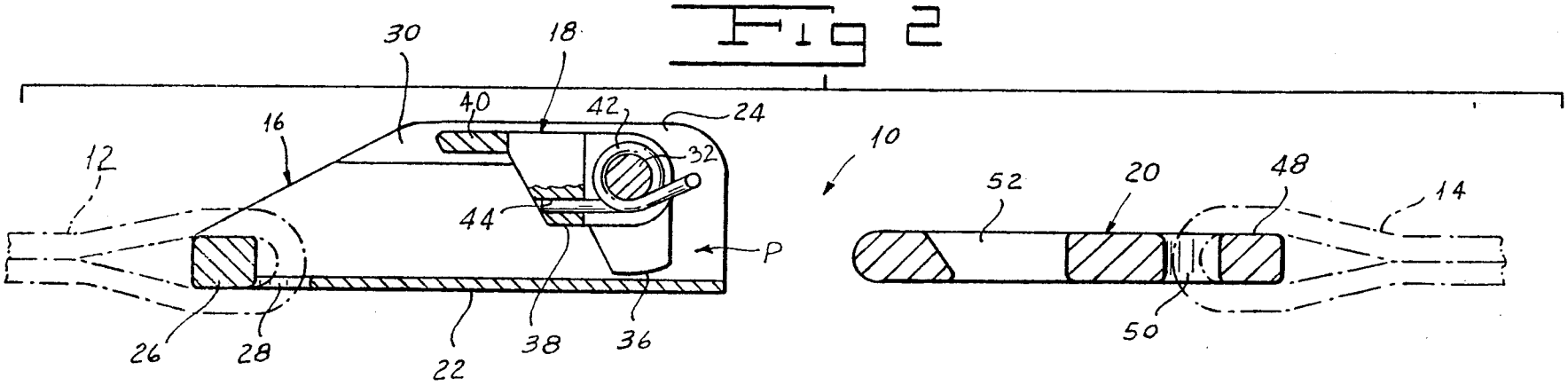
FIG. 2 is a section of the buckle assembly of FIG. 1, taken along line 2—2 thereof.
Figure 4:
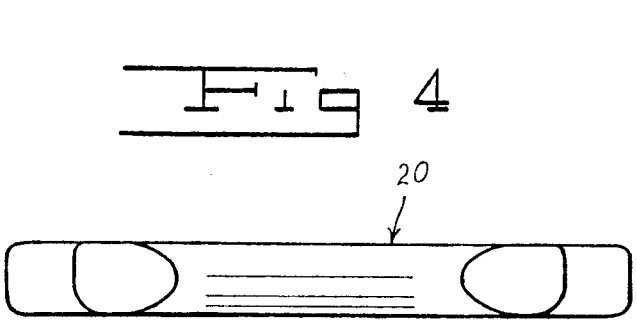
FIG. 4 is a left side elevation of the tongue of the buckle assembly of FIG. 1.
Figure 3:
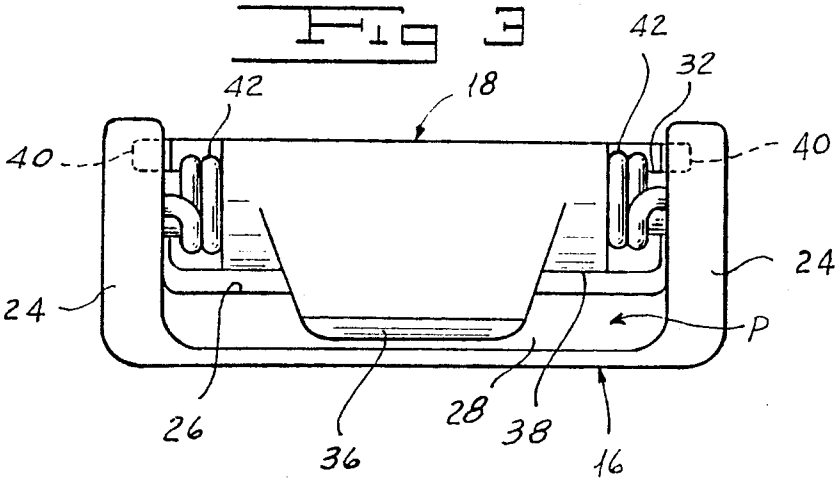
FIG. 3 is a right side elevation of the base-and-latch subassembly of the buckle assembly of FIG. 1.

Referring now also to FIG. 4, tongue 20 is inserted into the passageway P formed between bottom wall 22 of base 16 and latch 18 to secure the assembly 10. Tongue 20 includes a portion 48 formed with a slot 50 for receiving a loop of the other strap end 14. Tongue 20 is formed with a recess 52 for receiving the downwardly extending portion 36 of latch 18 to lock the assembly 10. Preferably, tongue 20 has a rounded end as shown in FIG. 2.

Referring now to FIGS. 5 to 7, prior to the insertion of tongue 20 into the passageway P in base 16, latch 18 is in a position approximating that shown in FIG. 5, with torsion springs 42 biasing latch handle 40 downwardly against recesses 30 of sidewalls 24. When inserted into the passageway P, tongue 20 engages downwardly extending latch portion 36 to push latch 18 clockwise, against the action of springs 42 to the position shown in FIG. 6. Upon further insertion of tongue 20 to a point at which the leading wall of recess 52 clears latch portion 36, springs 42 move latch 18 counterclockwise to the position shown in FIG. 7, in which handle 40 is spaced from the lower surfaces of recesses 30 and springs 42 urge latch portion 38 against the upper surface of the leading portion of tongue 20. Since handle 40 is recessed within the general outline of sidewalls 24, it cannot easily be inadvertently actuated. If at this point one attempts to withdraw the tongue 20 from the passageway P, the leading wall of recess 52 bears against the adjacent surface portion of latch portion 36 to exert an additional counterclockwise torque on latch 18. This torque causes latch portion 38 to bear even more forcefully against the upper surface of tongue 20 so as to clamp it with even greater force. This clamping action is especially advantageous in noisy environments such as the interiors of helicopters, where the sound pressure causes loosely fitting parts to vibrate with an annoying rattle or buzz. To release tongue 20 from base 16, the wearer pulls handle 40 upwardly to rotate latch 18 clockwise to the position shown in FIG. 6 in which latch portion 36 is clear of the recess 52, permitting tongue 20 to be withdrawn from the passageway P.

It will be seen that I have accomplished the objects of my invention. My buckle assembly remains fastened under high loads, and actually becomes more resistant to separation with an increase of applied load. My buckle assembly has a low profile, and thus resists inadvertent release in normal and threatening environments. At the same time, it has a quick release for emergency egress. Finally, my buckle assembly is light weight and simple to operate.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A buckle assembly including in combination a tongue having a recess, a base defining a passageway for receiving said tongue, and a latch supported by said base adjacent to said passageway for pivotal movement about and axis, said latch having a catch adapted to extend into said recess in a locking position of said latch to retain said tongue in said passageway and having a portion adapted to abut said tongue from a direction generally normal to the direction of said passageway in said locking position of said latch, said latch being movable beyond said locking position in the absence of said tongue in said passageway, said abutting portion being so located along said passageway relative to said axis that attempted withdrawal of said tongue from said passageway produces a movement about said axis to cause said abutting portion to clamp said tongue against said base, said base including a pair of sidewalls, one of which is formed with a recess therein, said latch having a portion extending into said recess to limit movement of said latch.

2. An assembly as in claim 1 in which each of said sidewalls has a recess formed therein, said latch having portions extending into said recesses to limit the movement of said latch.

3. A buckle assembly including in combination a tongue having a recess, a base having a pair of sidewalls defining a passageway for receiving said tongue, a latch supported by said base adjacent to said passageway for pivotal movement about an axis, said latch having a catch adapted to extend into said recess to retain said tongue in said passageway and a handle adapted to extend along said passageway, means for biasing said handle toward said passageway, and means on one of said sidewalls for defining a limit stop preventing the movement of said handle toward said passageway beyond a predetermined position while permitting movement of said handle away from said passageway beyond said predetermined position, said limit stop means being transversely spaced from the other of said sidewalls to define a gap therebetween.

4. An assembly as in claim 3 including means on both of said sidewalls for preventing the movement of said handle beyond said predetermined position.

5. An assembly as in claim 3 in which said one of said sidewalls is formed with a recess therein, said handle having a portion extending into said recess to prevent the movement thereof beyond said predetermined position.

6. An assembly as in claim 3 in which said handle is recessed within the general outline of said sidewalls in said predetermined position.

7. An assembly as in claim 3 in which said tongue is adopted to be inserted into said passageway in a predetermined direction, said handle extending in said direction from said axis in said predetermined position.

8. A buckle assembly including in combination a tongue having a recess, a base defining a passageway for receiving said tongue, a latch supported by said base adjacent to said passageway for pivotal movement about an axis, said latch having a catch adapted to extend into said recess in a locking position of said latch to retain said tongue in said passageway and having a portion adapted to abut said tongue from a direction generally normal to the direction of said passageway in said locking position of said latch, said latch being movable beyond said locking position in the absence of said tongue in said passageway, and means for biasing said abutting portion toward said passageway to clamp said tongue against said base, said base including a pair of sidewalls, one of which is formed with a recess therein, said latch having a portion extending into said recess to limit the movement of said latch.

9. An assembly as in claim 8 in which each of said sidewalls has a recess formed therein, said latch having portions extending into said recesses to limit the movement of said latch.

* * * * *